US007421087B2

(12) United States Patent
Perkins et al.

(10) Patent No.: US 7,421,087 B2
(45) Date of Patent: Sep. 2, 2008

(54) TRANSDUCER FOR ELECTROMAGNETIC HEARING DEVICES

(75) Inventors: Rodney C. Perkins, Woodside, CA (US); Sunil Puria, Sunnyvale, CA (US); Jonathan P. Fay, San Mateo, CA (US); John Winstead, Sunnyvale, CA (US)

(73) Assignee: EarLens Corporation, Palo Alto, CA (US)

( * ) Notice: Subject to any disclaimer, the term of this patent is extended or adjusted under 35 U.S.C. 154(b) by 662 days.

(21) Appl. No.: 10/902,660

(22) Filed: Jul. 28, 2004

(65) Prior Publication Data

US 2006/0023908 A1 Feb. 2, 2006

(51) Int. Cl.
*H04R 25/00* (2006.01)

(52) U.S. Cl. ..... 381/331; 381/322; 381/326; 381/328

(58) Field of Classification Search ..... 381/151, 381/322, 324, 326, 328, 331
See application file for complete search history.

(56) References Cited

U.S. PATENT DOCUMENTS

| | | | |
|---|---|---|---|
| 5,015,225 | A | 5/1991 | Hough et al. |
| 5,259,032 | A | 11/1993 | Perkins et al. |
| 5,276,910 | A | 1/1994 | Buchele |
| 5,425,104 | A | 6/1995 | Shennib |
| 5,456,654 | A | 10/1995 | Ball |
| 5,797,834 | A | 8/1998 | Goode |
| 6,084,975 | A | 7/2000 | Perkins et al. |
| 6,137,889 | A | 10/2000 | Shennib et al. |
| 6,339,648 | B1 | 1/2001 | McIntosh et al. |
| 6,277,148 | B1 | 8/2001 | Dormer |
| 6,354,990 | B1 | 3/2002 | Juneau et al. |
| 6,366,863 | B1 | 4/2002 | Bye et al. |
| 6,387,039 | B1 | 5/2002 | Moses |
| 6,393,130 | B1 | 5/2002 | Stonikas et al. |
| 6,432,248 | B1 | 8/2002 | Popp et al. |
| 6,436,028 | B1 | 8/2002 | Dormer |
| 6,438,244 | B1 | 8/2002 | Juneau et al. |
| 6,473,512 | B1 | 10/2002 | Juneau et al. |
| 6,475,134 | B1 | 11/2002 | Ball et al. |
| 6,493,454 | B1 | 12/2002 | Loi et al. |
| 6,592,513 | B1 | 7/2003 | Kroll et al. |
| 6,603,860 | B1 | 8/2003 | Taezner et al. |

(Continued)

OTHER PUBLICATIONS

Decraemer et al., "A Method For Determining Three-Dimensional Vibration In the Ear," *Hearing Research*, 77 (1-2): 19-37 (1994).

(Continued)

*Primary Examiner*—Suhan Ni
(74) *Attorney, Agent, or Firm*—Townsend and Townsend and Crew LLP; James M. Heslin

(57) ABSTRACT

A hearing system for producing audio signals perceptible to an individual. The hearing system includes a transducer having a surface adapted to attach to a middle-ear acoustic member of the individual, wherein the transducer is responsive to variations in a magnetic field emitted by a transmitter to directly vibrate the acoustic member. The transmitter is supported within an ear canal of the individual. The transmitter has a coil and a core positioned so that the distal end of the core is located at a predetermined distance and orientation relative to the transducer.

42 Claims, 7 Drawing Sheets

U.S. PATENT DOCUMENTS

| | | | | |
|---|---|---|---|---|
| 6,676,592 | B2 | 1/2004 | Ball et al. | |
| 6,695,943 | B2 | 2/2004 | Juneau et al. | |
| 6,940,989 | B1 * | 9/2005 | Shennib et al. | 381/326 |
| 2001/0027342 | A1 | 10/2001 | Dormer | |
| 2002/0183587 | A1 | 12/2002 | Dormer | |

OTHER PUBLICATIONS

Fay et al., "Cat Eardrum Response Mechanics," Mechanics and Computation Division, Department of Mechanical Engineering, Stanford University, (2002), 10 pages total.

Hato et al., "Three-Dimensional Stapes Footplate Motion in Human Temporal Bones." *Audiol Neurootol*, 8: 140-152, (2003).

Moore, "Loudness Perception and Intensity Resolution", *Cochlear Hearing Loss*, Whurr Publishers Ltd., (1998), Chapter 4, pp. 90-115.

Puria and Allen, "Measurements and Model of the Cat Middle Ear: Evidence of Tympanic Membrane Acoustic Delay," *Journal of the Acoustical Society of America*, 104 (6): 3463-3481 (1998).

Puria et al., "Sound-Pressure Measurements In The Cochlear Vestibule of Human-Cadaver Ears," *Journal of the Acoustical Society of America*, 101 (5-1): 2754-2770, (1997).

* cited by examiner

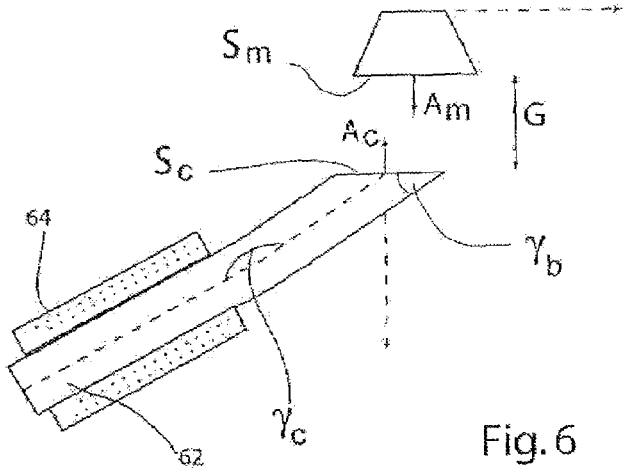
Fig. 6
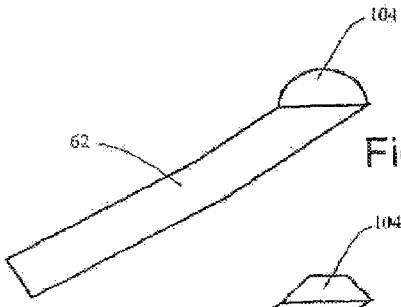
Fig. 7A
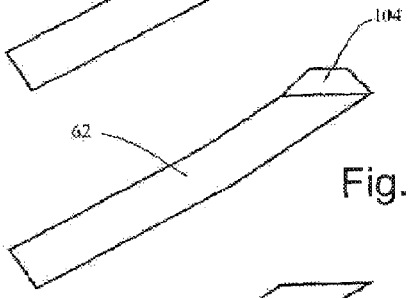
Fig. 7B
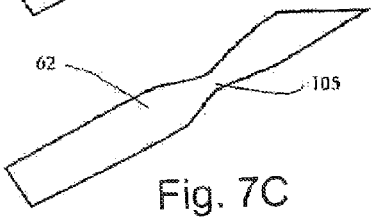
Fig. 7C
Fig. 8
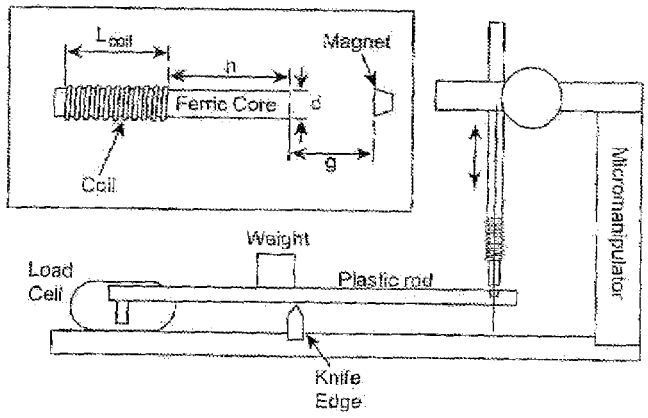

TRANSDUCER FOR ELECTROMAGNETIC HEARING DEVICES

BACKGROUND OF THE INVENTION

1. Field of the Invention

The present invention relates generally to hearing systems and methods. More particularly, the invention is directed to hearing systems and methods that rely on electromagnetic fields to produce vibrations on a portion of the human ear. Such systems may be used to enhance the hearing process with normal or impaired hearing.

Presently, most hearing systems fall into at least three categories: acoustic hearing systems, electromagnetic drive hearing systems, and cochlear implants. Acoustic hearing systems rely on acoustic transducers that produce amplified sound waves which, in turn, impart vibrations to the tympanic membrane or eardrum. The telephone earpiece, radio, television and aids for the hearing impaired are all examples of systems that employ acoustic drive mechanisms. The telephone earpiece, for instance, converts signals transmitted on a wire into vibrational energy in a speaker which generates acoustic energy. This acoustic energy propagates in the ear canal and vibrates the tympanic membrane. These vibrations, at varying frequencies and amplitudes, result in the perception of sound. Surgically implanted cochlear implants electrically stimulate the auditory nerve ganglion cells or dendrites in subjects having profound hearing loss.

Hearing systems that deliver audio information to the ear through electromagnetic transducers are well known. These transducers convert electromagnetic fields, modulated to contain audio information, into vibrations which are imparted to the tympanic membrane or parts of the middle ear. The transducer, typically a magnet, is subjected to displacement by electromagnetic fields to impart vibrational motion to the portion to which it is attached, thus producing sound perception by the wearer of such an electromagnetically driven system. This method of sound perception possesses some advantages over acoustic drive systems in terms of quality, efficiency, and most importantly, significant reduction of "feedback," a problem common to acoustic hearing systems.

Feedback in acoustic hearing systems occurs when a portion of the acoustic output energy returns or "feeds back" to the input transducer (microphone), thus causing self-sustained oscillation. The potential for feedback is generally proportional to the amplification level of the system and, therefore, the output gain of many acoustic drive systems has to be reduced to less than a desirable level to prevent a feedback situation. This problem, which results in output inadequate to compensate for hearing losses in particularly severe cases, continues to be a major problem with acoustic type hearing aids. To minimize the feedback to the microphone, many acoustic hearing devices close off, or provide minimal venting, to the ear canal. Although feedback may be reduced, the tradeoff is "occlusion," a tunnel-like hearing effect that is problematic to most hearing aid users. Directly driving the eardrum can minimize the feedback because the driving mechanism is mechanical rather than acoustic. Because of the mechanically vibrating eardrum, sound is coupled to the ear canal and wave propagation is supported in the reverse direction. The mechanical to acoustic coupling, however, is not efficient and this inefficiency is exploited in terms of decreased sound in the ear canal resulting in increased system gain.

One system, which non-invasively couples a magnet to tympanic membrane, is disclosed by Perkins et al. in U.S. Pat. No. 5,259,032, incorporated herein by reference. The above-mentioned patent discloses a device for producing electromagnetic signals having a transducer assembly which is weakly but sufficiently affixed to the tympanic membrane of the wearer by surface adhesion. U.S. Pat. No. 5,425,104, also incorporated herein by reference, discloses a device for producing electromagnetic signals incorporating a drive means external to the acoustic canal of the individual. However, because magnetic fields decrease in strength as the reciprocal of the square of the distance ($1/R^2$), previous methods for generating audio carrying magnetic fields are highly inefficient and are thus not practical. At the present, there is considerable room for improvement in the delivery of electromagnetic fields sufficient to efficiently drive a transducer coupled to an acoustic member of an individuals ear.

For these reasons it would be desirable to provide an improved hearing system, which delivers electromagnetic fields to a transducer, that is coupled to an acoustic member of an individual's ear sufficiently to drive the transducer with minimal power. It would further be desirable to provide a hearing system leaving an open channel in the ear canal to minimize occlusion. At least some of these objectives will be met by the inventions described hereinafter.

2. Description of the Background Art

U.S. Pat. Nos. 5,259,032 and 5,425,104 have been described above. Other patents of interest include: U.S. Pat. Nos. 5,015,225; 5,276,910; 5,456,654; 5,797,834; 6,084,975; 6,137,889; 6,277,148; 6,339,648; 6,354,990; 6,366,863; 6,387,039; 6,432,248; 6,436,028; 6,438,244; 6,473,512; 6,475,134; 6,592,513; 6,603,860; 6,676,592; and 6,695,943. Other publications of interest include: U.S. patent Publication Nos. 2002-0183587, 2001-0027342; Journal publications Decraemer et al. (1994), Puria et al. (1997), Moore (1998), Puria and Allen (1998), Fay et al. (2002), and Hato et al. (2003).

BRIEF SUMMARY OF THE INVENTION

According to the present invention, a hearing system for producing audio signals perceptible to an individual comprises a transducer having a surface adapted to an external surface of a middle-ear acoustic member of the individual, wherein the transducer is passively responsive to variations in a magnetic field to directly vibrate the acoustic member. The system has a transmitter supported within an ear canal of the individual to transmit the magnetic field to the transducer. The transmitter has a coil with an open interior and sized to fit in the ear canal, and a core having a proximal end and a distal end, the core sized to fit within the open interior of the coil such that the distal end of the core is located at a predetermined distance and orientation relative to the transducer. The system further includes a power source to supply a current to the coil of the transmitter, the current being representative of the audio signals.

In a preferred embodiment, the transducer is releasably attached to a tympanic membrane of the individual. Alternatively, the transducer may be attached to another acoustic member of the middle ear, such as the malleus, incus or stapes of the individual.

Where the transducer is attached to the tympanic membrane, the system generally has a support means for retaining the transducer to the tympanic membrane. Typically, the support means comprises of a non-reactive pre-formed biocompatible material having a contact surface of an area and configuration sufficient for releasably supporting the transducer on the external surface of the tympanic membrane. The transducer generally comprises a magnet.

Preferably, the core and the coil are sized such that the transmitter forms an open channel in the ear canal. In most configurations, the system comprises a shell having an inner surface and an outer surface, where the outer surface shaped to engage the walls of the individual's ear canal. The inner surface is sized to accommodate attachment of the transmitter while maintaining an open-channel in the ear canal to permit natural sound to travel to the tympanic membrane.

In some embodiments, the coil is wrapped around the core, and the coil/core assembly is attached to the inner surface of the shell. Alternatively, the coil is laid onto the inner surface of the shell, and the core is attached within the coil.

In a preferred embodiment, the distal end of the core comprises a beveled surface that is inclined with respect to the axis of the core. Typically, the beveled surface is oriented substantially parallel to the transducer when the transmitter is positioned in the ear canal.

The distal end of the core may be a cone-shaped surface, a wedge-shaped surface, or any other shape that maximizes the surface area of the distal end of the core, for a given core diameter, while maintaining proper orientation of the distal surface with respect to the magnet axis. The core is composed at least partly of iron, or any other suitable magnetic material.

In one aspect of invention, the core is bent and/or pinched to accommodate the geometry of the individual's ear canal. In general, the distal end of the core is positioned within a range of 1 to 8 mm from the transducer. Preferably, the distal end of the core is positioned within a range of 2 to 6 mm from the transducer.

In another aspect of the invention, a microphone is coupled to the transmitter, through an analog or digital means of signal processing, for capturing audio information to be transmitted by the transmitter. The microphone may be located inside the ear canal, at the canal entrance, or near the outer ear. Preferably, the microphone is located at the entrance of the ear canal, also called the concha, along with the transmitter.

In yet another aspect of the invention, a hearing method for producing audio signals perceptible to an individual comprises: releasably supporting a transducer on an external surface of a middle-ear acoustic member, the transducer being responsive to a magnetic field; positioning a transmitter within an ear canal of the individual, the transmitter having a magnetic coil and a core wherein the core has a distal surface which extends into the ear canal at a predetermined distance and orientation from the transducer; and delivering current to the transmitter to emit a magnetic field from the distal surface, the current being representative of the audio signals.

In a preferred embodiment, the transducer is releasably supported on an external surface comprises supporting the transducer on a tympanic membrane of the individual. Alternatively, the transducer is supported on a malleus of the individual.

Typically, positioning a transmitter comprises fitting a shell to match the interior contours of the individual's ear canal, and wherein the shell supports the transmitter. Often, the transmitter is positioned by first measuring the physical characteristics of the individual's ear canal and tympanic membrane, wherein the transmitter is attached to the shell according to the measured characteristics. In many cases, the physical characteristics of the individual's ear canal are measured by making a mold of the individual's ear canal and tympanic membrane. Alternatively, measuring the physical characteristics of the individual's ear canal and tympanic membrane comprises generating a three-dimensional CT, microCT, MRI, microMRI scan, or any other optical scan of the individual's ear canal and tympanic membrane.

Generally, the core is sized according to the measured characteristics, and the core is oriented according to the measured characteristics of the individual's ear canal. In some embodiments, the core comprises a proximal end and a distal end, and the transmitter is positioned by positioning the distal end of the core at a predetermined distance from the transducer. Generally, the core is positioned in the range of 1 mm to 8 mm from the transducer. Preferably, the distal end of the core is positioned in the range of 2 mm to 6 mm from the transducer.

In some embodiments, the transmitter is also positioned by orienting a surface of the distal end of the core to be substantially parallel to the transducer. Optimally, the distal end of the core is beveled to increase the surface area of the distal end of the core, and the beveled surface of the core is oriented to be substantially parallel to the transducer. The magnetic axis of the core is positioned to maximally align with the magnetic axis of the transducer, which moves the acoustic member in a preferred direction. The shell, coil and core may also be sized so that the transmitter forms an open channel with the ear canal.

BRIEF DESCRIPTION OF THE DRAWINGS

FIG. 6 is an illustration of the placement of the core and coil assembly with respect to the transducer.

FIGS. 7A, 7B and 7C show alternative embodiments of the transmitter core of the present invention.

FIG. 8 is an illustration of a test set-up to measure the magnetic forces applied to the magnet at varying positions and orientations with respect to the core.

DEFINITIONS

Figure 1:
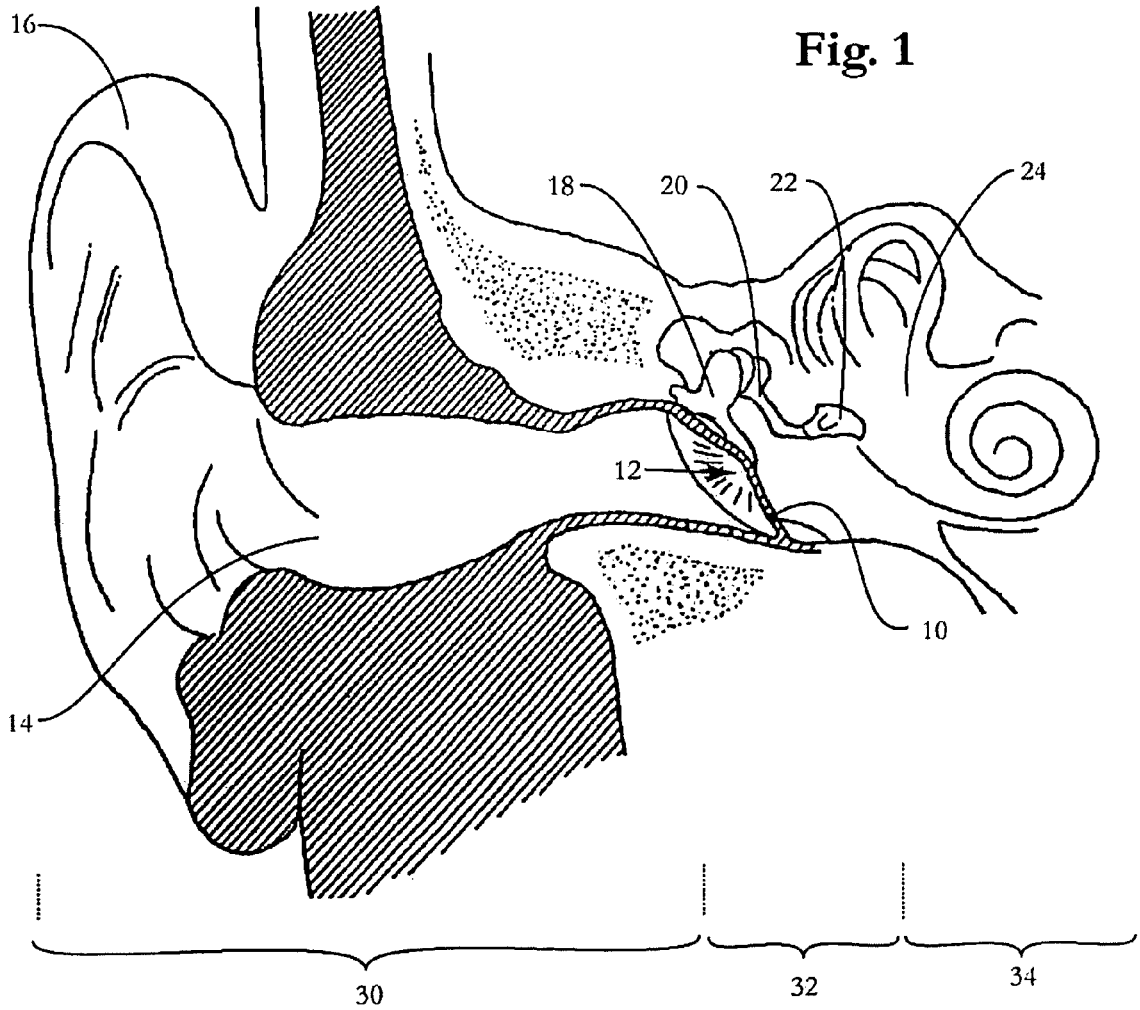
FIG. 1 is a section view of the human ear, including the outer ear, middle ear, and part of the inner ear.

In the present specification and claims, reference will be made to phrases and terms of art, which are expressly defined for use herein as follows:

As used herein, a high-energy permanent magnet includes samarium-cobalt ($S_mC_o$), neodymium-iron-boron ($N_dF_eB$) or any other rare earth magnet material as appropriate.

As used herein, a support means is a biocompatible structure with an appropriate area to non-invasively attach a transducer to a portion of the ear without the need for hardening adhesives such as glue, or the need for such surgical procedures as insertion into the tympanic membrane, connection with malleus clips, or placement on, bones of the middle ear. By contrast, the support means can be facilely installed and removed by an individual with minimal effort, and has elements which are easily taken on and off by a user. The support means uses the phenomenon of surface adhesion to weakly but sufficiently attach an electromagnetic transducer on the tympanic membrane without being displaced when it is vibrated, or when an individual's head or body experiences motion or vibration.

As used herein, a transducer is a device which is responsive to appropriate energy signals to produce vibrations that contain audio information and transfer the audio information when vibrationally coupled to an acoustic member of an individual's ear. A transducer may comprise a magnet, piezoelectric elements, passive or active electronic components in discrete, integrated, or any singular component or combination of components that will impart vibrational motion to the tympanic membrane or other portion of the body in response to appropriately received signals or any other means suitable for converting signals to vibrations.

As used herein, a transmitter is any device comprising of a coil or core combination that transmits acoustic or other meaningful signals electromagnetically to the transducer.

As used herein, an acoustic member is a portion of an individual's ear that is capable of propagating sound waves, along the ossicular chain to stimulate the auditory mechanisms of the inner ear. An acoustic member includes, but is not limited to, any one of the following: tympanic membrane, malleus, incus, and stapes.

DETAILED DESCRIPTION OF THE INVENTION

The hearing system of the current invention comprises an electromagnetic hearing system having a transmitter for producing electromagnetic signals that contain audio information, and a transducer assembly, which receives the signals and imparts vibrations to the ear. Electromagnetic hearing systems rely on electrical signals to produce electromagnetic energy rather than acoustic energy. This electromagnetic energy has the same amplitude and frequency variation characteristics as the driving electrical signal. Subsequently, these electromagnetic fields induce vibrations of the magnet attached to a location in the ear and produce audible sounds of the same characteristics as the original source signals. The transmitter and transducer assembly will be described in greater detail with reference to the accompanying Figures.

Referring now to FIG. 1, there is shown a cross sectional view of outer ear 30, middle ear 32 and inner ear 34 (part). The outer ear comprises primarily of the pinna 16 and the ear canal 14. The middle ear is bounded by the tympanic membrane (ear drum) 10 on one side, and contains a series of three tiny interconnected bones: the malleus (hammer) 18; the incus (anvil) 20; and the stapes (stirrup) 22. Collectively, these three bones are known as the ossicles or the ossicular chain. The malleus is attached to the tympanic membrane 22 while the stapes, the last bone in the ossicular chain, is coupled to the cochlea 24 of the inner ear.

In normal hearing, sound waves that travel via the outer ear or auditory canal 14 strike the tympanic membrane and cause it to vibrate. The malleus, being connected to the tympanic membrane, is thus also set into motion, along with the incus and the stapes. These three bones in the ossicular chain act as a set of impedance matching levers of the tiny mechanical vibrations received by the tympanic membrane. The tympanic membrane and the bones may act as a transmission line system to maximize the bandwidth of the hearing apparatus (Puria and Allen, 1998; Fay et al. 2002). The stapes vibrates in turn causing fluid pressure in the vestibule of a spiral structure known as the cochlea 24 (Puria et al., 1997). The fluid pressure results in a traveling wave along the longitudinal axis of the the basilar membrane. The organ of Corti sits atop the basilar membrane which contains the sensory epithelium consisting of one row of inner hair cells and three rows of outer hair cells. The inner-hair cells (not shown) in the cochlea are stimulated by the movement of the basilar membrane. There, hydraulic pressure displaces the inner ear fluid and mechanical energy in the hair cells is transformed into electrical impulses, which are transmitted to neural pathways and the hearing center of the brain (temporal lobe), resulting in the perception of sound. The outer hair cells are believed to amplify and compress the input to the inner hair cells. When there is sensory-neural hearing loss the outer hair cells are typically damaged reducing the input to the inner hair cells which results in a reduction in the perception of sound. Amplification by a hearing device restores the otherwise normal amplification and compression provided by the outer hair cells.

Figure 2:
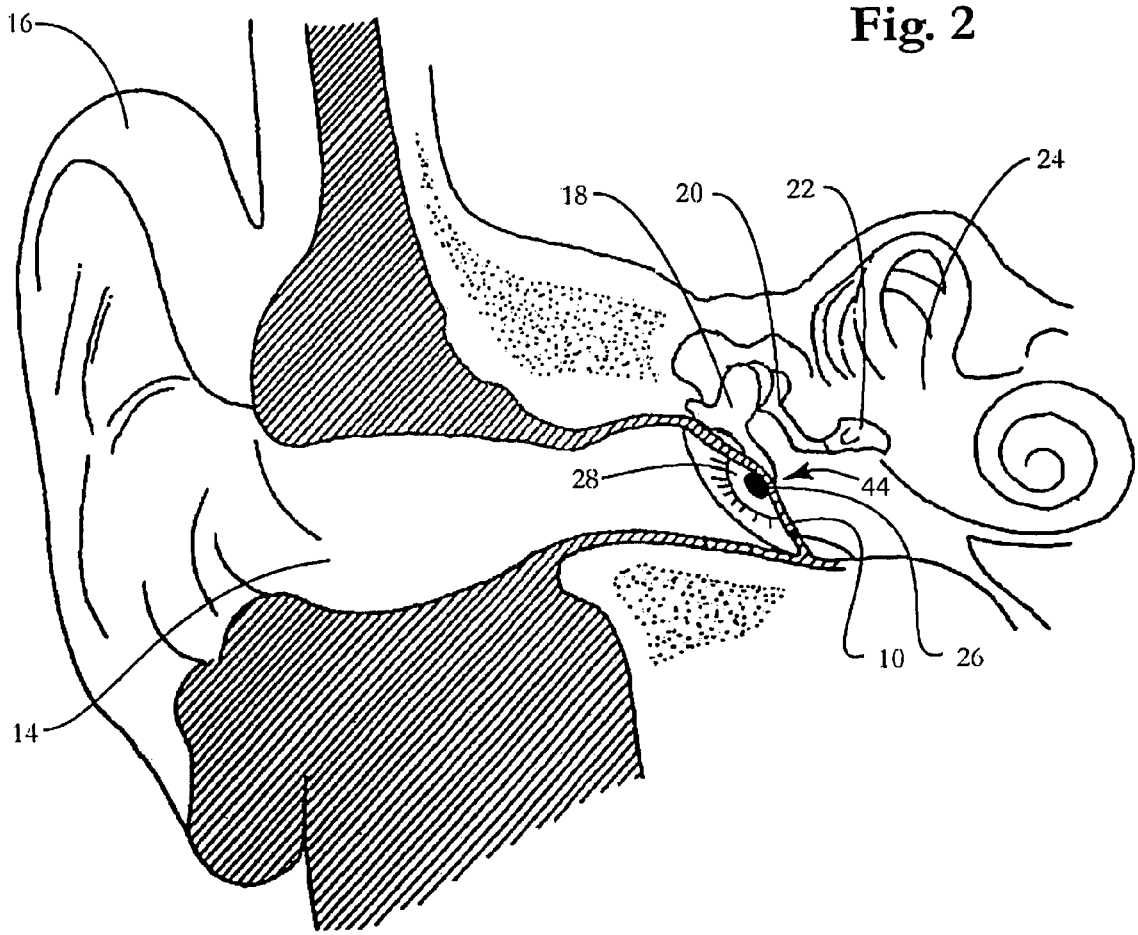
FIG. 2 illustrates an embodiment of the present invention with a transducer coupled to the tympanic membrane.

FIG. 2 depicts an embodiment of the present invention wherein a transducer 26 resides on the exterior surface of the tympanic membrane. By residing on the surface is meant that the transducer 26 is placed in contact with an exterior surface of the tympanic transducer. The transducer generally comprises a high-energy permanent magnet. A preferred method of so positioning the transducer is to employ a contact transducer assembly that includes transducer 26 and support means 28. Support means 28 is attached to, or floating on, a portion of the tympanic membrane 10 at the opposite surface of support means 28. The support means is a biocompatible structure with a surface area sufficient to support the transducer, and is vibrationally coupled to the tympanic membrane. Preferably, the surface of support means 28 that is attached to the tympanic membrane substantially conforms to the shape of the corresponding surface of the tympanic membrane, particularly the umbo area 12. A surface wetting agent, such as mineral oil, is preferably used to enhance the ability of support means 28 to form a weak but sufficient attachment to the tympanic membrane through surface adhesion. A suitable contact transducer assembly is described in U.S. Pat. No. 5,259,032, previously incorporated herein by reference.

Figure 3A:
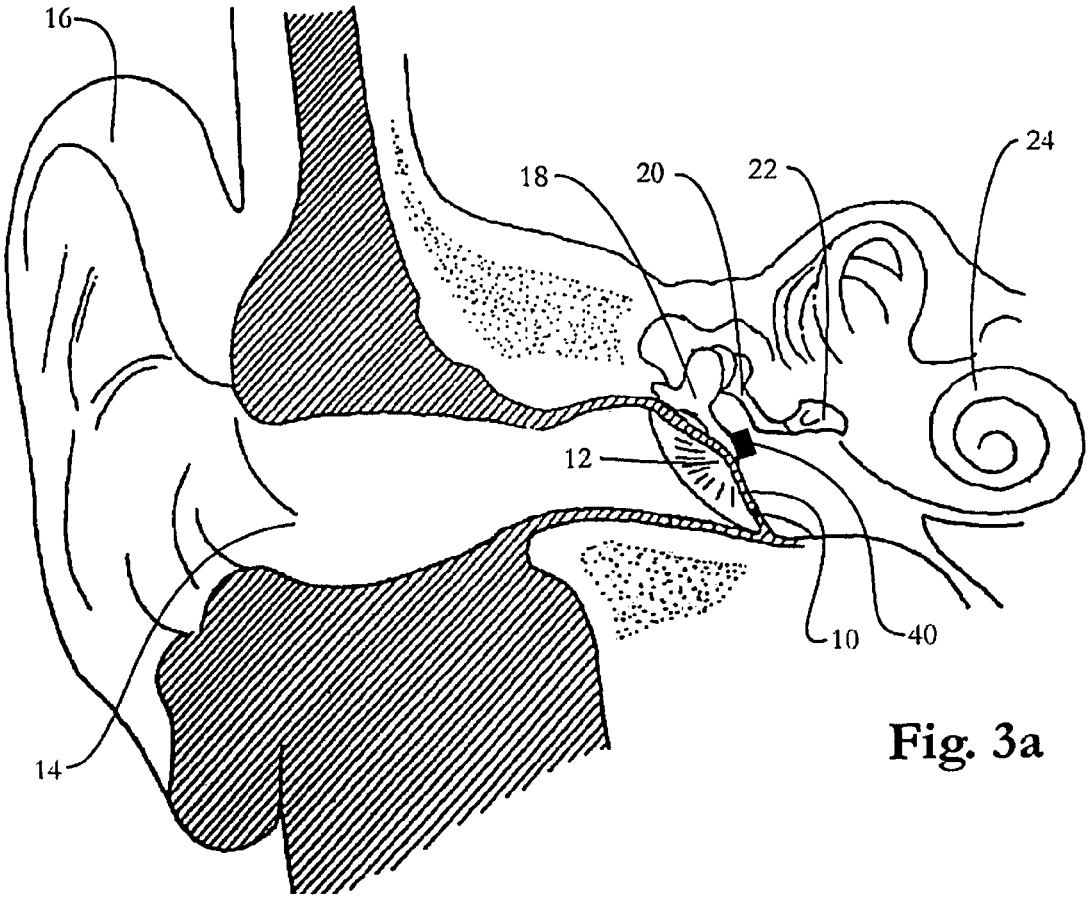
FIGS. 3A and 3B illustrate alternative embodiments of the transducer coupled to the malleus.
Figure 3B:
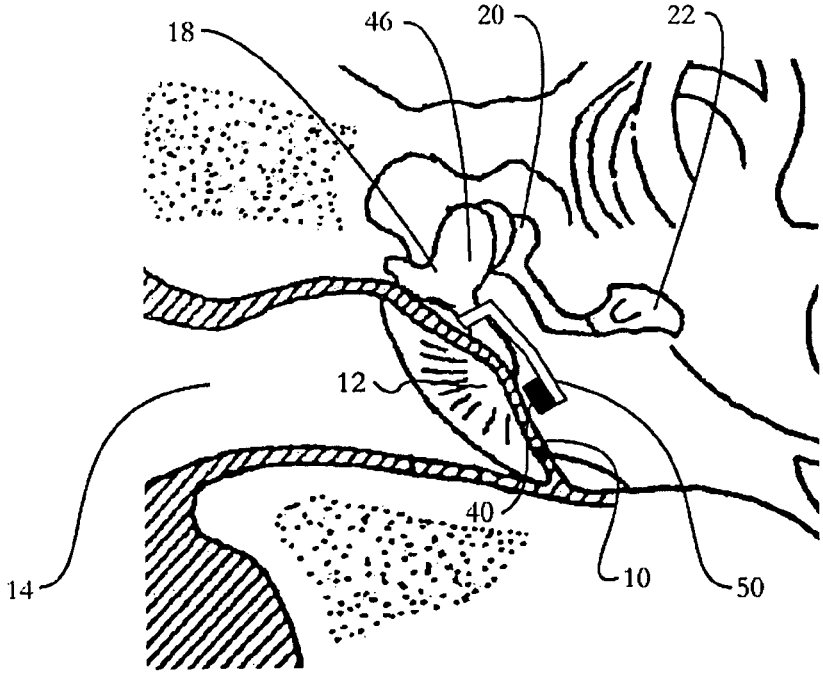

FIGS. 3A and 3B illustrate alternative embodiments wherein the transducer is placed on the malleus of an individual. In FIG. 3A, transducer magnet 40 is attached to the medial side of the inferior manubrium. Preferably, magnet 40 is encased in titanium or other biocompatible material. By way of illustration, one method of attaching magnet 40 to the malleus is disclosed in U.S. Pat. No. 6,084,975, incorporated herein by reference, wherein magnet 40 is attached to the medial surface of the manubrium 44 of the malleus 18 by making an incision in the posterior periosteum of the lower manubrium, and elevating the periosteum from the manubrium, thus creating a pocket between the lateral surface of the manubrium and the tympanic membrane 10. One prong of a stainless steel clip device may be placed into the pocket, with the magnet 40 attached thereto. The interior of the clip is of appropriate dimension such that the clip now holds onto the manubrium placing the magnet on its medial surface.

Alternatively, FIG. 3B illustrates an embodiment wherein clip 50 is secured around the neck of the malleus 18, in between the manubrium 44 and the head 46 of the malleus. In this embodiment, the clip 50 extends to provide a platform of orienting the magnet 40 toward the tympanic membrane 10 and ear canal 14 such that the magnet is in an optimal position to receive electromagnetic signals.

Figure 4A:
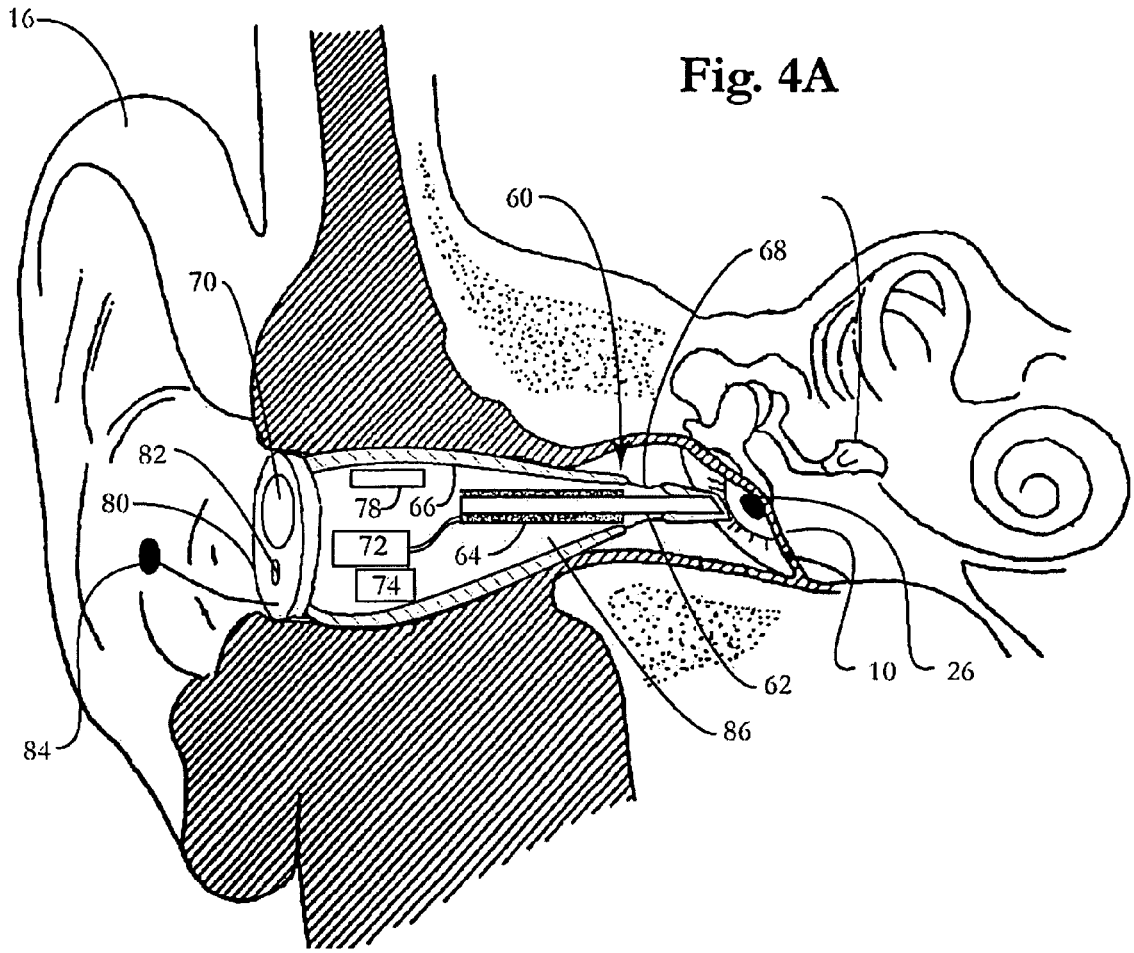
FIG. 4A illustrates an embodiment of the present invention with the transmitter installed in the ear canal and the transducer installed on the tympanic membrane.

Referring now to FIG. 4A, a transmitter assembly 60 (illustrated with shell 66 cross-sectioned for clarity) of the present invention is shown installed in a right ear canal and oriented with respect to the transducer 26. In the preferred embodiment of the current invention, the transducer assembly 26 is positioned against tympanic membrane 10 at umbo area 12. The transducer may also be placed on other acoustic members of the middle ear, including locations on the malleus 18 (shown in FIGS. 3A and 3B), incus 20, and stapes 22. When placed in the umbo area 12 of the tympanic membrane 10, the transducer 26 will be naturally tilted with respect to the ear canal 14. The degree of tilt will vary from individual to individual, but is typically at about a 60-degree angle with respect to the ear canal The transmitter assembly 60 has a shell 66 configured to mate with the characteristics of the individual's ear canal wall. Shell 66 is preferably matched to fit snug in the individual's ear canal so that the transmitter assembly 60 may repeatedly be inserted or removed from the ear canal and still be properly aligned when re-inserted in the individual's ear. Shell 66 is also configured to support coil 64 and core 62 such that the tip of core 62 is positioned at a proper distance and orientation in relation to the transducer 26 when the transmitter assembly is properly installed in the ear canal. The core 62 generally comprises ferrite, but may be any material with high magnetic permeability.

In a preferred embodiment, coil 64 is wrapped around the circumference of the core 62 along part or all of the length of the core. Generally, the coil has a sufficient number of rotations to optimally drive an electromagnetic field toward the transducer. The number of rotations may vary depending on the diameter of the coil, the diameter of the core, the length of the core, and the overall acceptable diameter of the coil and core assembly based on the size of the individual's ear canal. Generally, the force applied by the magnetic field on the magnet will increase, and therefore increase the efficiency of the system, with an increase in the diameter of the core. These parameters will be constrained, however, by the anatomical limitations of the individual's ear. The coil 64 may be wrapped around only a portion of the length of the core, as shown in FIG. 4A, allowing the tip of the core to extend further into the ear canal 14, which generally converges as it reaches the tympanic membrane 10.

One method for matching the shell 66 to the internal dimensions of the ear canal is to make an impression of the ear canal cavity, including the tympanic membrane. A positive investment is then made from the negative impression. The outer surface of the shell is then formed from the positive investment which replicated the external surface of the impression. The coil 64 and core 62 assembly can then be positioned and mounted in the shell 66 according to the desired orientation with respect to the projected placement of the transducer 26, which may be determined from the positive investment of the ear canal and tympanic membrane. In an alternative embodiment, the transmitter assembly 60 may also incorporate a mounting platform (not shown) with micro-adjustment capability for orienting the coil and core assembly such that the core can be oriented and positioned with respect to the shell and/or the coil. In another alternative embodiment, a CT, MRI or optical scan may be performed on the individual to generate a 3D model of the ear canal and the tympanic membrane. The digital 3D model representation may then be used to form the outside surface of the shell and mount the core and coil.

As shown in the embodiment of FIG. 4A, transmitter assembly 60 may also comprise a digital signal processing (DSP) unit 72, microphone 74, and battery 78 that are placed inside shell 66. The proximal end of the shell 66 has a faceplate 80 that can be temporarily removed to provide access to the open chamber 86 of the shell 66 and transmitter assembly components contained therein. For example, the faceplate 80 may be removed to switch out battery 78 or adjust the position or orientation of core 62. Faceplate 80 may also have a microphone port 82 to allow sound to be directed to microphone 74. Pull line 84 may also be incorporated into the shell 66 of faceplate 80 so that the transmitter assembly can be readily removed from the ear canal.

In operation, ambient sound entering the auricle 16 and ear canal 14 is captured by the microphone 74, which converts sound waves into analog electrical signals for processing by the DSP unit 72. The DSP unit 72 may be coupled to an input amplifier (not shown) to amplify the signal and convert the analog signal to a digital signal with a analog to digital converter commonly used in the art. The digital signal is then processed by any number of digital signal processors commonly used in the art. The processing may consist of any combination of multi-band compression, noise suppression and noise reduction algorithms. The digitally processed signal is then converted back to analog signal with a digital to analog converter. The analog signal is shaped and amplified and sent to the coil 64, which generates a modulated electromagnetic field containing audio information representative of the audio signal and, along with the core 62, directs the electromagnetic field toward the transducer magnet 26. The transducer magnet 26 vibrates in response to the electromagnetic field, thereby vibrating the middle-ear acoustic member to which it is coupled (e.g. the tympanic membrane 10 in FIG. 4A or the malleus 18 in FIGS. 3A and 3B).

In many embodiments, face plate 80 also has an acoustic opening 70 to allow ambient sound to enter the open chamber 86 of the shell. This allows ambient sound to travel through the open volume 86 along the internal compartment of the transmitter assembly and through one or more openings 68 at the distal end of the shell 66. Thus, ambient sound waves may reach and vibrate the tympanic membrane 10 and separately impart vibration on the membrane. This open-channel design provides a number of substantial benefits. First, the open channel minimizes the occlusive effect prevalent in many acoustic hearing systems from blocking the ear canal. Second, the natural ambient sound entering the ear canal allows the electromagnetically driven effective sound level output to be limited or cut off at a much lower level than with a design blocking the ear canal. For most hearing-impaired subjects, sound reproduction at higher decibel ranges is not necessary because their natural hearing mechanisms are still capable of receiving sound in that range. To those familiar in the art, this is commonly referred to as the recruitment phenomena where the loudness perception of a hearing impaired subject "catches up" with the loudness perception of a normal hearing person at loud sounds (Moore, 1998). Thus, the open-channel device may be configured to switch off, or saturate, at levels where natural hearing takes over. This can greatly reduce the currents required to drive the transmitter, allowing for smaller batteries and/or longer battery life. A large opening is not possible in acoustic hearing aids because of the increase in feedback and thus limiting the functional gain of the device. In the inventive electromagnetically driven device, acoustic feedback is significantly reduced because the tympanic membrane is directly vibrated. This direct vibration ultimately results in generation of sound in the ear canal because the tympanic membrane acts as a loudspeaker cone. However, the level of generated acoustic energy is significantly less than in conventional hearing aids that generate direct acoustic energy in the ear canal. This results in much greater functional gain for the inventive open ear canal electromagnetic transmitter and transducer than with conventional acoustic hearing aids.

Figure 4B:
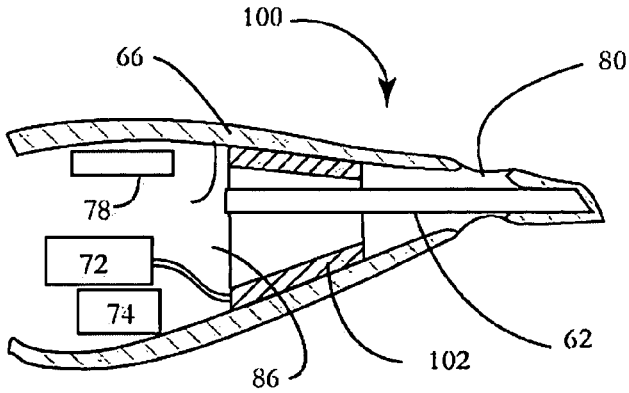
FIG. 4B illustrates an alternative embodiment of the present invention with the coil laid along the inner walls of the shell.

FIG. 4B illustrates an alternative embodiment of a transmitter assembly 100 wherein the coil 102 is laid on the inner walls of the shell 66. The core 62 is positioned within the inner diameter of the coil 102 and may be attached to either the shell 66 or the coil 102. In this embodiment, ambient sound may still enter ear canal and pass through the open chamber 86 and out the ports 80 to vibrate the tympanic membrane.

Figure 5A:
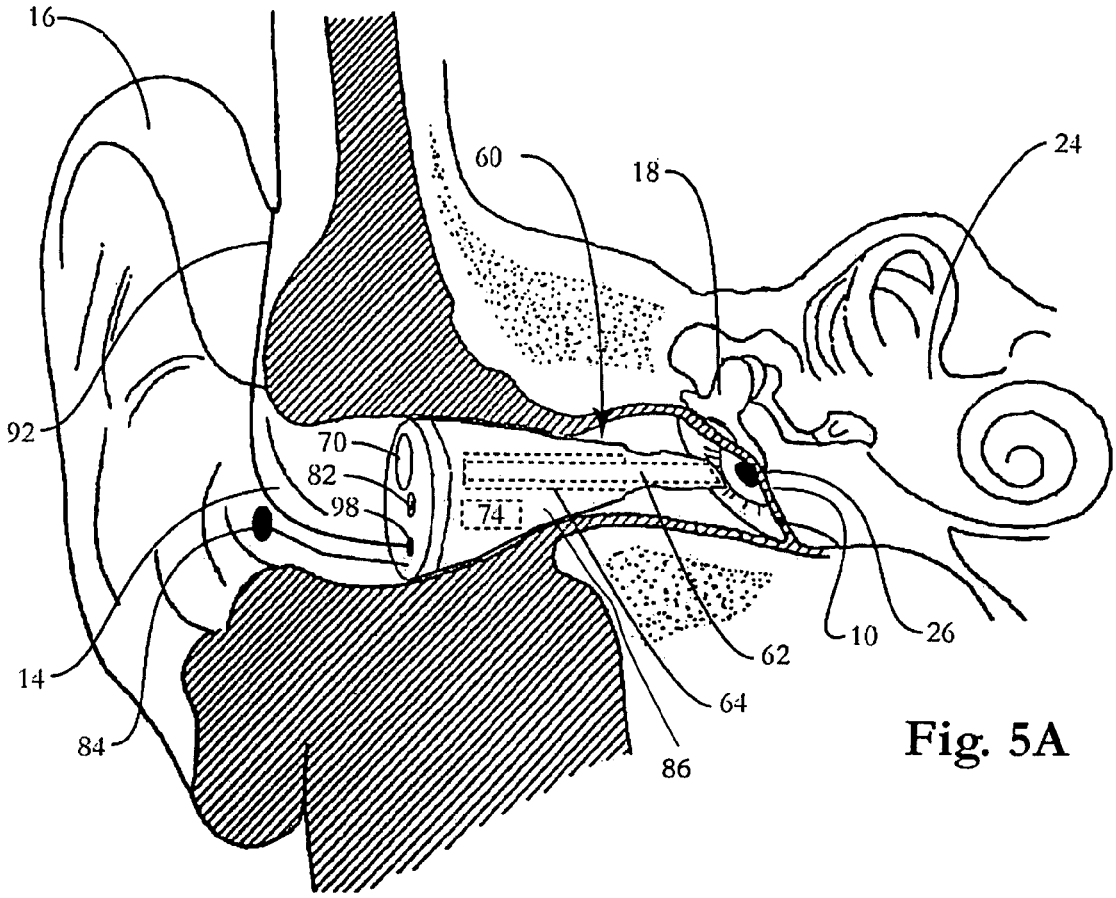
FIGS. 5A and 5B are schematic views of an embodiment of the invention incorporating an external driver assembly.
Figure 5B:
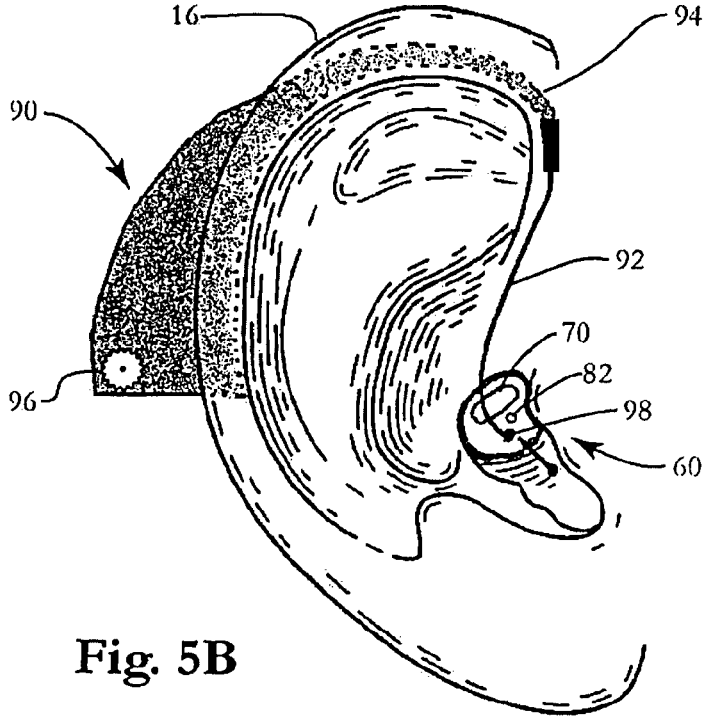

Now referring to FIGS. 5A and 5B, an alternative embodiment is illustrated wherein one or more of the DSP unit, battery, or microphone are located external to the ear canal in driver unit 90. Driver unit 90 may hook on to the top end of the auricle 16 via ear hook 94. This configuration provides additional clearance for the open chamber 86 of shell 66 (FIG. 4B), and also allows for inclusion of components that would not otherwise fit in the ear canal of the individual. Although the microphone 74 may be located external to the outer ear along with the driver unit 90, it is preferable to have the microphone located in or at the opening of the ear canal 14 to gain benefit of high bandwidth localization cues from the auricle 16. As shown in FIGS. 5A and 5B, sound entering the ear canal 14 is captured by microphone 74 through microphone port 82. The signal is then sent to the DSP located in the driver unit 90 for processing via an input wire in cable 92 connected to jack 98 in faceplate 80. Once the signal is processed by the DSP, the signal is delivered to the coil 64 by an output wire passing back through cable 92.

FIG. 6 illustrates a diagram of the position of the core 62 in relation to the transducer 26. The core 62 may be individually sized according the dimensions of the individual's ear canal. For example, the core may be cut to a length that allows the core to extend down the ear canal 14 so that the tip of the core 62 is positioned in close proximity to the installed transducer, while also providing sufficient length for the coil to be wrapped around the core toward the proximal end of the core where the ear canal opening is larger to accommodate for the larger coil diameter. The core 62 may also be bent by angle $\gamma_c$, wherein the angle $\gamma_c$ corresponds to the individual geometry of the ear canal so that the core tip can be properly placed in close proximity to the transducer 26 without interfering with the ear canal walls.

In a preferred embodiment, surface $S_c$ of the core tip may be beveled or inclined at an angle $\gamma_b$ with respect to the core axis. The beveled surface not only increases the surface area of the core tip, but it also helps in orienting surface $S_c$ to be substantially parallel to the lateral surface of the transducer magnet $S_m$, so that the magnetic axis $A_c$ of the core 62 is orthogonal to the magnet surface $S_m$ and in line with the magnetic axis $A_m$ of the magnet 26. The direction that most stimulates the inner ear is the piston like motion of the stapes 22 (Hato et al., 2002). This motion of the stapes is maximized when the motion perpendicular to the to umbo of tympanic membrane 10 is maximized in comparison to motions along the other dimensions (Decraemer et al. 1994). Therefore, the system is most efficient, with the force on the magnet 26 maximized with the magnetic field generated by the core directed perpendicular to the umbo and the magnet 26 lying parallel to the plane of the umbo (either attached to the tympanic membrane or other acoustic member such as the malleus). Additionally, the core magnetic axis $A_c$ aligned with the magnet axis $A_m$ also imparts the minimum shear force on the contact surface between the magnet support 28 and the tympanic membrane 10, therefore minimizing the possibility of the transducer assembly improperly decoupling from the tympanic membrane.

As illustrated in FIGS. 7A and 7B, the core tip may have a number of alternative surfaces for varying the magnetic field emitted by the transmitter. The core tip 104 may be conical, spherical, concave or convex, thereby increasing the surface area of the core tip. For such alternative surfaces, the magnet will generally be matched to the shape of the core tip for proper reception of the magnetic field. FIG. 7C illustrates a reduction in dimension 105 of the core for a section of the ear canal to accommodate a pinch in the ear canal anatomy. The dimension in the orthogonal direction is correspondingly increased to maintain the core area.

Ideally, the core tip surface $S_c$ will be positioned at a distance G from the transducer external surface $S_m$ to generate the highest possible gain from the system, while also being far enough from the transducer 26 such that the attractive forces between the magnet and the core do not separate the transducer 26 from the tympanic membrane (if so attached). The magnetic field density generally decreases as a function of the square of the gap distance G between the core tip surface and the magnet surface. Thus the closer the coil is to the magnet, the stronger magnetic force on the magnet, and the more efficient the system. Generally, a distance of between 1 mm and 8 mm was found to be effective for transmission of the electromagnetic field, and preferably between 2 mm and 6 mm.

In one laboratory study using the setup employed in FIG. 8, various tests were performed comparing coil/core characteristics such as core length and diameter, number of coil turns, core materials, gap distance, and orientation. Generally, increasing the core diameter, decreasing core length, increasing the number of turns of the coil will have a proportional increase in the strength of the magnetic field. However, these parameters were shown to have a negligible impact on performance as compared to gap distance and core tip orientation with respect to the magnet.

Figure 9:
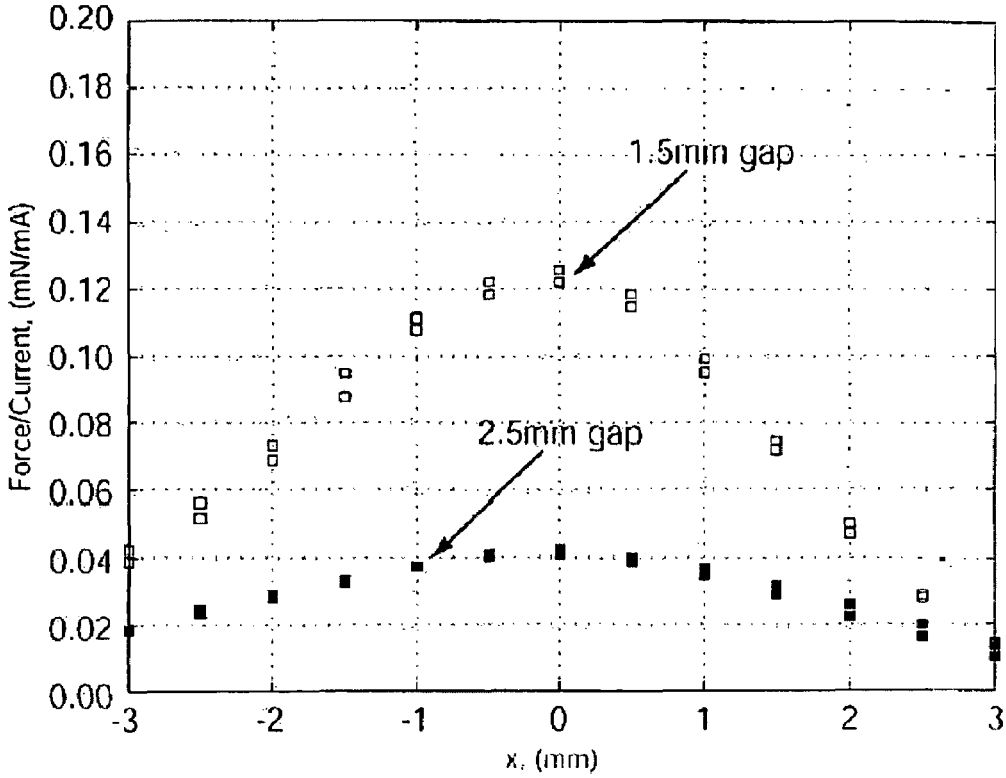
FIG. 9 is a graph showing test results of the magnetic force induced on the magnet at different gap distances (1000 turn coil).

FIG. 9 illustrates a test performed to measure the magnetic force with a load cell (FIG. 8) at two different gap distances, 2.5 mm and 1.5 mm, as well as varying the alignment of the magnet with the core in the horizontal "x" direction. Repeat measurements from two different runs are shown. The magnetic force varied by up to a factor of three between the readings for a 1.5 mm gap as opposed to a 2.5 mm gap, with the highest variance occurring when the magnet and core were lined up with each other in the x axis (0 mm). The magnetic force was also fairly affected by the alignment of the core and magnet in the x direction. However, the test showed that there was negligible loss between −0.5 mm and 0.5 mm.

Figure 10:
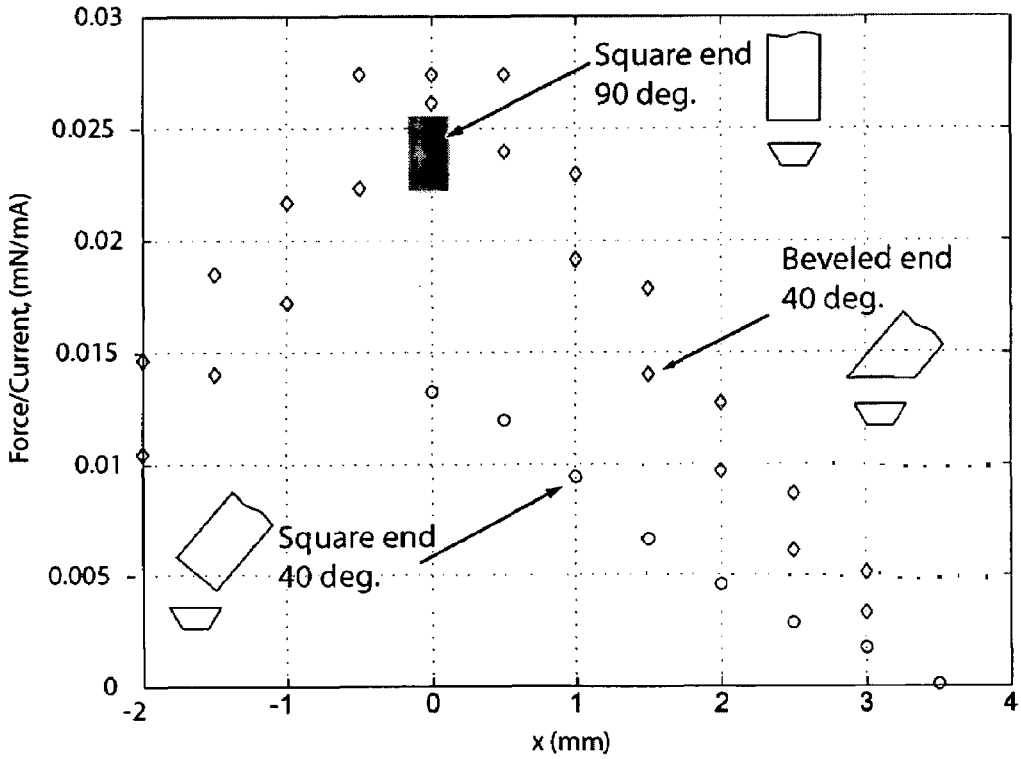
FIG. 10 is a graph showing test results of the magnetic force induced on the magnet at different orientation angles of the core tip with respect to the magnet (250 turn coil).

FIG. 10 illustrates another test performed to measure the magnetic force with the core magnetic axis $A_c$ at different angles relative to the magnet surface. The test showed that the force on the magnet nearly doubled with the core magnetic axis $A_c$ oriented at a 90° angle to the magnet surface as opposed to a 40°-tilt angle, both with a square end. However, with a 40°-tilt angle beveled-end core, similar gains to the 90°-angle case were achieved. The slightly higher gain in the beveled tip than the 90°-angle case is from the increase in surface area due to beveling.

The foregoing description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

What is claimed is:

1. A hearing system for producing audio signals perceptible to an individual, comprising:

a transducer having a surface adapted to attach to an acoustic member of the individual, the transducer being responsive to variations in a magnetic field to directly vibrate the acoustic member;

a transmitter supported within an ear canal or external ear of the individual to the transducer, the transmitter comprising:

i. a coil having an open interior, the coil being sized to fit in the ear canal or external ear; and ii. a magnetic core having a proximal end and a distal end, the magnetic core sized to fit within the open interior of the coil such that a distal end of the magnetic core is located at a predetermined distance and orientation relative to the transducer;

and a power source to supply a current to the coil of the transmitter, the current being representative of the audio signals.

2. A hearing system as in claim 1, wherein the transducer is adapted to be releasably attached to a tympanic membrane of the individual.

3. A hearing system as in claim 1, wherein the transducer is adapted to be attached to a malleus of the individual.

4. A hearing system as in claim 2, further comprising a support means for retaining the transducer to the tympanic membrane.

5. A hearing system as in claim 4, wherein the support means comprises of a non-reactive pre-formed biocompatible material having a contact surface of an area and configuration sufficient for releasably supporting the transducer on the external surface of the tympanic membrane.

6. A hearing system as in claim 1, wherein the transducer comprises a magnet.

7. A hearing system as in claim 1, wherein the core and the coil are sized such that the transmitter forms an open channel in the ear canal.

8. A hearing system as in claim 7, further comprising a shell having an inner surface and an outer surface, the outer surface shaped to engage the waits of the individual's ear canal, the inner surface sized to accommodate attachment of the transmitter while maintaining an open-channel in the ear canal to permit natural sound to travel to the tympanic membrane.

9. A hearing system as in claim 8, wherein the coil is laid onto the inner surface of the shell, and the core is attached to the coil.

10. A hearing system as in claim 8, wherein the coil is wrapped around the core, and the coil/core assembly is attached to the inner surface of the shell.

11. A hearing system as in claim 1, wherein the distal end of the core comprises a beveled surface.

12. A hearing system as in claim 11, wherein the beveled surface is oriented substantially parallel to the transducer when the transmitter is positioned in the ear canal.

13. A hearing system as in claim 11, wherein a magnetic axis of the core is aligned with a magnetic axis of the transducer.

14. A hearing system as in claim 1, wherein the distal end of the core comprises a cone-shaped surface.

15. A hearing system as in claim 1, wherein the distal end of the core comprises wedge-shaped surface.

16. A hearing system as in claim 1, wherein the core is composed any magnetically conductive material.

17. A hearing system as in claim 1, wherein the core is bent to accommodate the geometry of the ear canal.

18. A hearing system as in claim 1, wherein the core is pinched to accommodate the geometry of the ear canal.

19. A hearing system as in claim 1, wherein the distal end of the core is positioned within a range of 1 to 8 mm from the transducer.

20. A hearing system as in claim 19, wherein the distal end of the core is positioned within a range of 2 mm to 6 mm from the transducer.

21. A hearing system as in claim 1, further comprising a microphone coupled to the transmitter through an analog or digital means of signal processing.

22. A hearing system as in claim 21, wherein the microphone is located inside the ear canal along with the transmitter.

23. A hearing system as in claim 21, wherein the microphone is located in the external ear.

24. A hearing method for producing audio signals perceptible to an individual, comprising:

releasably supporting a magnetic transducer on an external surface of an acoustic member of an ear, the transducer being passively responsive to a magnetic field;

positioning a transmitter within an ear canal of the individual, the transmitter having a magnetic coil and a core wherein the core has a distal surface which extends into the ear canal at a predetermined distance and orientation from the transducer; and delivering current to the transmitter to emit a magnetic field from the distal surface, wherein the magnetic field drives the magnetic transducer to produce vibrations representative of the audio signals.

25. A method as in claim 24, wherein releasably supporting a transducer on an external surface comprises supporting the transducer on a tympanic membrane of the individual.

26. A method as in claim 24, wherein releasably supporting a transducer on an external surface comprises supporting the transducer on a malleus of the individual.

27. A method as in claim 24, wherein positioning a transmitter comprises fitting a shell to match the interior contours of the individual's ear canal, and wherein the shell supports the transmitter.

28. A method as in claim 27, wherein positioning a transmitter comprises measuring the physical characteristics of the individual's ear canal, wherein the transmitter is attached to the shell according to the measured characteristics.

29. A method as in claim 28, wherein measuring the physical characteristics of the individual's ear canal comprises making a mold of the individual's ear canal.

30. A method as in claim 28, wherein measuring the physical characteristics of the individual's ear canal comprises generating a CT, microCT, MRI, microMRI, or optical scan of the individual's ear canal.

31. A method as in claim 28, wherein positioning a transmitter comprises sizing the core according to the measured characteristics.

32. A method as in claim 28, wherein positioning a transmitter comprises orienting the core according to the measured characteristics.

33. A method as in claim 32, wherein the core comprises a proximal end and a distal end, and wherein positioning a transmitter comprises positioning the distal end of the core at a predetermined distance from the transducer.

34. A method as in claim 33, wherein the distal end of the core is positioned in the range of 1 mm to 8 mm from the transducer.

35. A method as in claim 34, wherein the distal end of the core is positioned in the range of 2 mm to 6 mm from the transducer.

36. A method as in claim 33, wherein positioning a transmitter comprises orienting a surface of the distal end of the core to be substantially parallel to the transducer.

37. A method as in claim 36, further comprising beveling the distal end of the core to increase the surface area of the distal end of the core, and wherein positioning a transmitter comprises orienting the beveled surface of the core to be substantially parallel to the transducer.

38. A method as in claim 33, wherein positioning a transmitter comprises orienting the magnetic axis of the distal end of the core to be aligned with the magnetic axis of the transducer.

39. A method as in claim 27, wherein positioning a transmitter comprises sizing the shell, coil and core so that the transmitter forms an open channel with the ear canal.

40. A. method as in claim 27, wherein positioning a transmitter comprises laying the coil onto the inner surface of the shell, and attaching the core to the coil.

41. A method as in claim 27, wherein positioning a transmitter comprises wrapping the coil around the core, and attaching the coil/core assembly to the inner surface of the shell.

42. A hearing system as in claim 21, wherein the microphone is located outside the external ear.

* * * * *